US007544412B2

(12) United States Patent
Humphreys et al.

(10) Patent No.: US 7,544,412 B2
(45) Date of Patent: Jun. 9, 2009

(54) REDUCING ABRASIVE WEAR IN WEAR RESISTANT COATINGS

(75) Inventors: Alan O. Humphreys, Somerville, MA (US); Partha Ganguly, Belmont, MA (US); Demosthenis Pafitis, Cambridge (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 317 days.

(21) Appl. No.: 11/363,872

(22) Filed: Feb. 28, 2006

(65) Prior Publication Data

US 2007/0202350 A1 Aug. 30, 2007

(51) Int. Cl.
*B32B 9/00* (2006.01)

(52) U.S. Cl. ..... 428/325; 51/307; 51/309; 428/469; 428/472; 428/698

(58) Field of Classification Search ..... 428/325, 428/469, 472, 698; 51/307, 309
See application file for complete search history.

(56) References Cited

U.S. PATENT DOCUMENTS 4,836,307 A * 6/1989 Keshavan et al. ..... 428/557
5,944,127 A * 8/1999 Liang et al. ..... 51/309
6,659,206 B2 * 12/2003 Liang et al. ..... 175/425

OTHER PUBLICATIONS

Hutchings, I.M. Tribology: *Friction and Wear of Engineering Materials*. Chapter 6: "Wear by hard particles." London: Edward Arnold, 1992: pp. 133-197.

* cited by examiner

*Primary Examiner*—Archene Turner
(74) *Attorney, Agent, or Firm*—Brigid Laffey; James McAleenan; Jody Lynn DeStefanis

(57) ABSTRACT

An abrasion resistant coating and method are provided wherein the abrasion resistant coating contains both ductile and brittle components having a bimodal size distribution. The abrasion resistant coating is initially applied to a substrate in contact with an abrasive environment. The abrasive resistant coating having a bimodal size distribution results in the minimized exposure of the ductile components of the wear surface to the abrasive environment such that the life of the abrasive resistant coating is extended.

15 Claims, 4 Drawing Sheets

REDUCING ABRASIVE WEAR IN WEAR RESISTANT COATINGS

FIELD OF THE INVENTION

The present invention relates to a method of improving the abrasive wear of hard-coatings, and more particularly to hard-coatings having a distribution of reinforcement throughout its microstructure.

BACKGROUND OF THE INVENTION

The surfaces of downhole tools, when in contact with an abrasive environment such as a borehole wall, can undergo a high level of abrasion. In light of this, these surfaces are oftentimes coated with an abrasive resistant coating, in an effort to reduce wear and extend tool life. For example, abrasive resistant coatings, or hard facings, are often applied to susceptible areas of a tool such as wear bands, directional drilling pressure pads and stabilizers. Coatings such as these are typically a particulate metal matrix composite, based on a nickel or cobalt alloyed matrix containing tungsten or titanium carbides particles. Using such a combination, both high degrees of hardness and toughness can be obtained.

These coatings are traditionally applied using a variety of methods such as weld overlays (MIG, plasma transfer arc, laser-cladding), thermal spray processes (high velocity oxygen fuel, D-gun, plasma spray, amorphous metal) and brazing (spray and fuse techniques) as know by those skilled in the art. In addition, wear resistant inserts, such as cemented tungsten carbide tiles or polycrystalline diamond (PDC, TCP) inserts are often attached to critical areas by brazing or other means to increase the wear resistance. Existing abrasive resistant coatings such as these result in the application of a coating over a substrate that has a non-uniform surface that is oftentimes rough in texture.

While numerous abrasive resistant coatings have been produced for wear-resistant applications, none have been specifically designed to withstand the harsh environmental conditions encountered in downhole environments. The rubbing of a metal against a rock formation in the presence of drilling mud under high stress, together with repeated impact loading, creates a unique set of mechanisms that can lead to very rapid material loss.

In such an environment, the abrasive wear exhibited by traditional abrasive resistant coatings can be divided into two categories, namely brittle wear and ductile wear. Brittle wear occurs due to cracking and material removal at the surface of the abrasive resistant coating while ductile wear is exhibited by gradual material removal which results in a smoothing effect on the surface. In contrast, ductile wear is described by a slow smoothing of the ductile component of the matrix material. Ductile wear in an abrasive resistant coating increases when more of the ductile components of the abrasive resistant coating are exposed to the abrasive environment. The extent by which an abrasive resistant coating exhibits brittle or ductile wear is dependent on the local load the material must bear while in operation as well as the individual components exposed to the abrasive environment. For example, if the material at the surface of the abrasive resistant coating is brittle and the load applied is higher than its fracture stress (fracture under compressive load), the wear mechanism is brittle. In the alternative, if the load applied to the abrasive resistant coating is less than the fracture stress of the abrasive resistant coating, material is removed by a ductile wear mechanism. The wear rate under brittle wear is significantly higher than that in ductile wear. See I. M. Hutchings, Tribology: Friction and Wear of Engineering Materials, 1992 (incorporated herein by reference in its entirety).

Existing approaches to minimizing wear in an abrasive resistant coating have resulted in the increase of the bulk hardness of the abrasive resistant coating by increasing the fraction of tungsten carbide reinforcement used in the abrasive resistant coating. Such an increase in the carbide volume fraction results in an increase of the wear resistance. However, at very high carbide volume fractions, extensive cracking can occur, as insufficient ductile matrix material is present to accommodate the residual stresses created during processing. For example, an abrasive resistant coating with a high carbide volume fraction applied using a plasma transfer arc method will likely result in a non-uniform surface that exhibits excessive cracking at various regions due to the lack of sufficient ductile matrix material. In the alternative, an abrasive resistant coating with a high percentage of exposed ductile material will undergoes rapid wear of the ductile matrix material, resulting in decreased abrasive resistant coating life.

In view of the above, a system, method and apparatus which results in the reduction of abrasive wear in abrasive resistant coatings is needed.

SUMMARY OF THE INVENTION

Aspects and embodiments of the present invention are directed to the reduction of the wear rate exhibited by a wear surface used within an abrasive environment. In one embodiment, an abrasive resistant coating for use within an abrasive environment is provided. To reduce the wear exhibited by this abrasive resistant coating, the area of exposed ductile material is minimized, such that harder brittle components are in contact with the abrasive environment. Brittle components such as these, as compared to the softer ductile components, provide increase service life and reduced wear of the abrasive resistant coating, as compared to contact of the softer ductile material with an abrasive environment.

This abrasive resistant coating of the present embodiment includes a substrate. This substrate may take numerous forms, and in one embodiment may include a tool such as a directional drilling apparatus. Additionally, a wear surface coating is provided wherein the wear surface coating is in contact with the substrate and the abrasive environment. This wear surface coating has both brittle components as well as ductile components. In accordance with the present embodiment, the interparticle spacing of the brittle components of the wear surface is minimized such that the area of the ductile components of the wear surface in contact with the abrasive environment is minimized. In accordance with the present embodiment, the brittle components may be tungsten carbide, and the ductile components may be nickel, arranged in a metal matrix arrangement.

Minimization of the interparticle spacing of the present embodiment may take numerous forms, including the use of a bimodal size distribution of brittle components having a primary brittle component size as well as brittle components having an interstitial brittle component size. The interstitial brittle components are typically smaller in size than the primary brittle components such that the exposed area of the ductile metal Matrix is minimized. Using a bimodal distribution of brittle components such as this allows for an interparticle spacing of brittle components less than 5 microns. Additionally, the brittle component, both primary and interstitial, may exhibit a spherical morphology to aid in reduction of contact stress between the brittle components and the abrasive environment. An applicable abrasive environment is a borehole of a oil, water, or gas well, for example.

Application of the wear surface to the substrate may be uniform in applied thickness, or may be non-uniform in applied thickness. A non-uniform application of the wear surface provides for the increased thickness of the wear surface in areas that exhibit the greatest wear. For example, an increased wear surface thickness may be applied to the leading edge of a tool.

In accordance with an alternate embodiment, a method for reducing the wear rate of an abrasive resistant coating in contact with an abrasive environment is provided. This method includes the steps of first providing a suitable substrate for application of the abrasive resistant coating. One such suitable substrate is a metallic tool element, such as a wear pad of a direction drilling apparatus. Applied to the substrate is a matrix wear surface, wherein the matrix wear surface has both brittle and ductile components. As these components are in contact with an abrasive environment, such as a borehole for example, the rate of wear is reduced if the exposure of the soft, ductile material in contact with the abrasive environment is minimized. Minimization of the exposed ductile material may be accomplished by selecting an interstitial particle size which results in roughly closed packed brittle components with a primary size. These roughly closed pack brittle components are situated such that the ductile material exposed to the environment is minimized, thereby resulting in decreased wear.

In one embodiment, these brittle components may be carbide components, wherein these carbide components are arranged within a ductile component such as nickel. Additionally, these ductile and brittle components may exhibit a spherical morphology which allows for the roughly closed packing of these components. The application of these components may take numerous forms, including a uniform thickness application to a substrate or a non-uniform application thickness application to a substrate. Application of the aforementioned components may occur on a variety of devices or substrates, including but not limited to a substrate such as a directional drilling apparatus suitable for use within a borehole.

In one embodiment, the interstitial spacing between roughly closed paced brittle components maybe about 2.6 to 3.4 microns. In an alternate embodiment of the present invention the ration of brittle components with a primary size to brittle components with an interstitial size is calculated such that sufficient hardness is provided within the matrix wear surface.

In accordance with an alternative embodiment of the present invention, a method for producing an abrasive resistant coating on a substrate is recited. This method includes the providing of a suitable ductile metal matrix as well as the providing of brittle components for use as a reinforcement within the ductile metal matrix, wherein these brittle components have a primary brittle component size and an interstitial brittle component size. Additionally, these brittle reinforcements and the ductile material matrix may be deposited onto the substrate wherein the primary brittle component size and interstitial brittle components sizes are selected to minimize the exposed area of the ductile metal matrix. In accordance with the present embodiment the brittle components may exhibit a bimodal size distribution or may exhibit a separation between the primary brittle components and the interstitial brittle components that is substantially equal. In accordance with one embodiment of the present invention the primary brittle component size is about 15-20 microns, while the interstitial brittle component size is about 5-6.6 microns. Furthermore, the interstitial size between primary brittle components and interstitial brittle components may be about 2.6 to 3.4 microns.

DETAILED DESCRIPTION OF THE INVENTION

Figure 1:
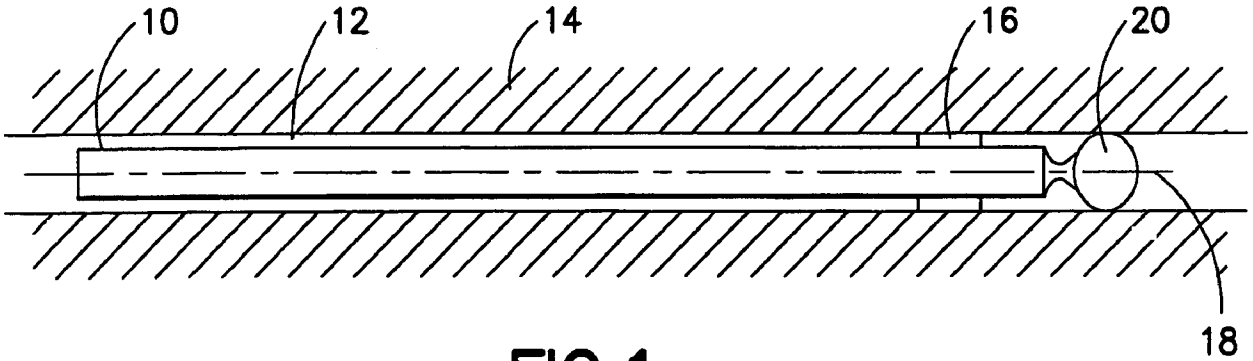
FIG. 1, an exemplary tool element using a coating system, method and apparatus suitable for use with the present invention.

Various embodiments and aspects of the invention will now be described in detail with reference to the accompanying figures. This invention is not limited in its application to the details of construction and the arrangement of components set forth in the following description or illustrated in the drawings. The invention is capable of various alternative embodiments and may be practiced using a variety of other ways. Furthermore, the terminology and phraseology used herein is solely used for descriptive purposes and should not be construed as limiting in scope. Language such as "including," "comprising," "having," "containing," or "involving," and variations herein, are intended to encompass the items listed thereafter, equivalents, and additional items not recited. Furthermore, the terms "hardface surface", "wear surface", "matrix wear surface", "abrasive resistant coating", "abrasion resistant surface" and variations herein will be used interchangeable to describe the present invention. Additionally, the term "bimodal" shall be defined to include all combinations of particles having at least two sizes, for example a primary size and an interstitial size. The use of the term bimodal shall not be construed as limiting particle sizes to solely two sizes and is intended to incorporate all particle distributions having more than a single particle size.

As illustrated in FIG. 1, an exemplary downhole tool is shown, wherein said tool embodies various aspects of the present invention. This downhole tool is, more particularly, a section of a directional drilling string assembly 10. This direction drilling string assembly 10 is used in the directional drilling of a wellbore 12 through an abrasive environment 14 such as a rock formation. In the present embodiment, the directional drilling string 10 includes wear pads 16 located in proximity to the cutting head 20. Furthermore, the cutting head 20 is free to deviate from the centerline of the wellbore axis 18 such that the direction of the wellbore 12 may be controlled. To effectuate a direction change from the centerline of the wellbore axis 18, the wear pad 16 is extended to push against the wellbore 12. This extension of the wear pad 16 may be accomplished using a variety of means, including but not limited to the use of hydraulic pressure or compressed air. For example, drilling fluid (mud) may be used as an appropriate hydraulic power source for actuating and extending the wear pad 16. Following extension of the wear pad 16, the cutting head 20 may be displaced relative to the centerline of the wellbore 18 such that a direction change is accomplished.

In the present embodiment the directional drilling string 10, and in particular the wear pad 16, is an example of an apparatus particularly suitable for use with a hardface or abrasive resistant coating. As the wear pad 16 is in direct contact with the abrasive environment 14, the use of an abrasive resistant coating aids in extending the life of the wear pad 16 while the tool is in use. While existing abrasive resistant coatings provide increased life of the wear pad 16, the abrasive resistant coating of the present invention is particularly suitable for extending the life of the wear pad 16 beyond that of existing coatings known by one skilled in the art. Additionally, elements such as the wear pad 16 of the present embodiment are often consumable items requiring periodic replacement as the abrasive resistant coating is compromised during use. Reducing the wear of the abrasive resistant coating, thereby extending the service life of an element like a wear pad 16, results in increased productivity and decrease costs, as the directional drilling drill string 10 need not be removed from the wellbore as frequently.

While the above description details the application of the present abrasive resistant coating to a directional drilling drill string 10, and more particularly to a wear pad 16 of said directional drilling drill string 10, one skilled in the art will readily recognize that the present invention may be utilized with a variety of alternative downhole tools or other elements not presently described herein including applications outside of the oilfield industry. For example, bearing surfaces or stabilizer regions associated with the drill string 10, wherein these bearing surfaces are in contact with the abrasive environment 12 of a borehole, may be additionally coated with the abrasive resistant coating of the present invention. Furthermore, the present invention can be applied to reduce abrasive wear in a variety of abrasive resistant coatings beyond the present embodiment illustrated in FIG. 1, including but not limited to the appropriate chemical, mechanical or metallurgical arts. The application of the present invention to these alternative uses, although not explicitly addresses in detail, is contemplated to be within the scope of the present invention. In view of this, the illustrated embodiment is not intended to be limiting in scope.

Figure 2:
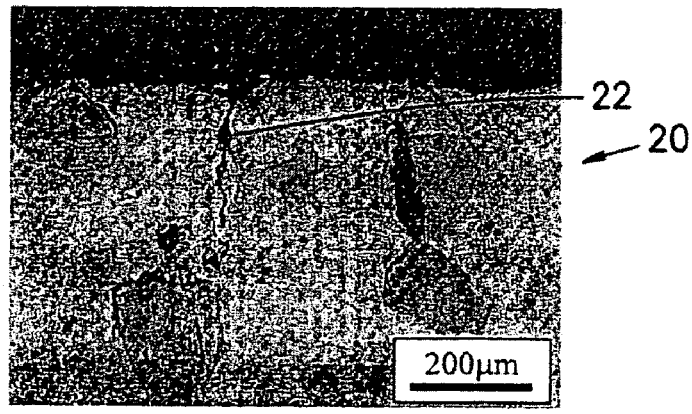
FIG. 2 is an illustrated example of a conventional hardface coating as know in the prior art.

FIG. 2 is a microscopic view of a conventional wear resistant coating as understood in the prior art. An abrasion resistant microstructure requires a material of both high hardness and toughness to minimize wear. Conventional hardfacing coatings consist of a ductile metallic matrix (usually cobalt or nickel) reinforced with a hard ceramic material such as tungsten or titanium carbide. This patent memo proposes using such an arrangement, with a nickel-based matrix reinforced with a distribution of tungsten carbide particles (hardness 2000-2400 HV). However, the innovative step is in the distribution of the reinforcement throughout the microstructure. As the rate of abrasion tends to decrease with increasing hardness of the impacted surface, abrasive resistant coating typically introduce tungsten carbide reinforcements, thus increasing the carbide volume fraction and increasing the wear resistance. However, at very high carbide volume fractions, extensive cracking can occur, as insufficient ductile matrix material is present to accommodate the residual stresses created during processing. Such cracking is exhibited in FIG. 2 which illustrates abrasive resistant coating known in the prior art. Cracks 22 propagating within the abrasive resistant coating 20 are exhibited in FIG. 2.

Figure 3:
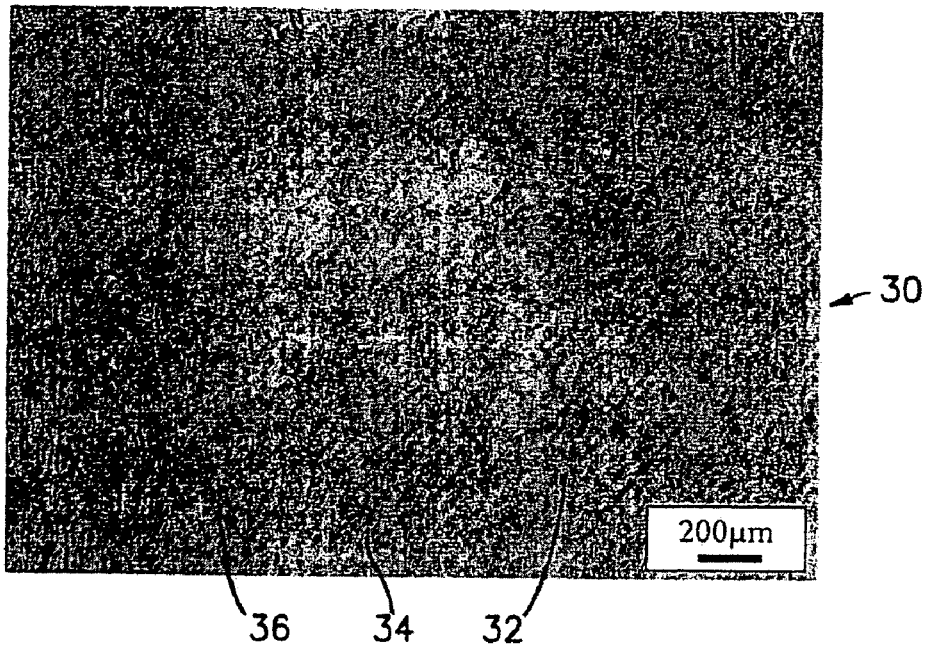
FIG. 3 is an illustrative example of micro abrasion of the exposed are between carbides

FIG. 3 is an illustrative example, as viewed through a microscope, of micro-abrasion of a wear surface which results in exposed areas between carbides 30. This exposed area may be a ductile component such as nickel. This nickel region of micro abrasions 32, 34, 36 may be caused by a variety of material in contact with the wear surface. For example, rock cuttings in mud may have a whole range of sizes, from several nm in size to less than 5 microns. Additionally, in laboratory analysis, silica particles on the order of 10 microns diameter were regularly observed embedded in the abraded surface. These rock cuttings and silica particles cause the micro-abrasion 32, 34, 36 in the region of exposed area between carbides 30. In accordance with the present invention, the abrasion illustrated in FIG. 3 may be minimized by reducing the area between carbides such that this area is sufficiently small and does not detrimentally suffer from abrasion. Therefore, to eliminate this abrasion mechanism, the interparticle carbide spacing should be less than about 5 microns.

Reduction of this area between carbides may be accomplished using carbide having spherical carbide morphology. The use of a spherical carbide morphology is beneficial as this carbide shape has less stress concentrations and therefore a lower critical fracture stress for a given carbide volume. A spherical carbide will also be less prone to dissolution in the surrounding matrix during processing (due to its reduced surface area), enabling an improved control of the final carbide size distribution.

Figure 4:
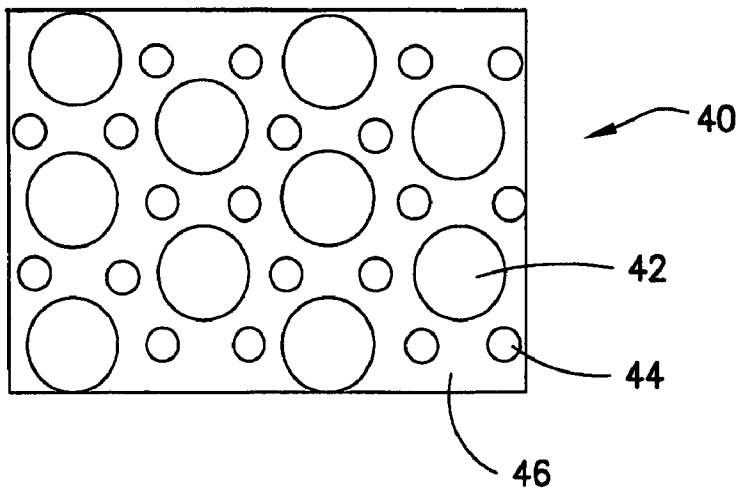
FIG. 4 is an example of a bimodal size distribution in accordance with one embodiment of the present invention.

FIG. 4 illustrates the use of spherical carbides having a bimodal size distribution of carbides in accordance with one embodiment of the present invention. The abrasion resistant coating with a bimodal size distribution 40 of FIG. 4 includes brittle components, such as carbides, with a primary size 42 and brittle components with an interstitial size 44 contained within a ductile component 46. In one embodiment the brittle components may be tungsten carbide components and the ductile component may be nickel based components. When employed within a borehole environment, calculations of vibrations along the bottom borehole assembly reveal that abrasion resistant tool coatings can be subject to shock loading in excess of 100 g. Assuming that the critical flaw size in a microstructure is equal to the diameter of carbide (15-20 microns), a bulk fracture toughness of approximately 2 MPa/m is required to withstand this shock loading. However, micro structural defects introduced during processing could be considerably larger than an individual carbide. Therefore, to ensure a degree of safety, the bulk fracture toughness should be an order of magnitude greater than this, i.e. in excess of 20 MPa/m. This is typically the order of magnitude of fracture toughness for abrasion resistant coatings containing tungsten carbide particles, thereby making tungsten carbide a suitable selection for a brittle component used with the present invention.

One skilled in the art will readily recognize that numerous alternative brittle and ductile components may be used in accordance with the present invention. For example, the primary brittle components 42 and interstitial brittle components 44 may represent different brittle component compositions. Additionally, suitable brittle components as understood by one skilled in the art be used in accordance with the present invention.

Using the aforementioned bimodal size distribution of brittle components, as illustrated in FIG. 4, the exposed area of matrix material can be minimized. Assuming that the brittle components assemble into a roughly close-packed arrangement during processing, there is one interstitial vacancy per carbide. Therefore, the total number of primary brittle components and interstitial brittle components should be equal. The ratio between the two brittle components sizes is important as the brittle component separation should be equal between both the primary brittle components and the interstitial brittle components to ensure minimal constraint of the matrix and therefore good toughness of the microstructure.

For illustrative purposes, a sample using carbide brittle components will be detailed. Such an illustration is not intended to be limiting in scope, as a variety of alternative brittle components exist which may be utilized in accordance with the present invention. In light of such language, for a primary carbide size of 15-20 microns diameter, calculations of the inter-carbide spacing show that the ideal interstitial carbide size is 5 to 6.6 microns in diameter. This equates to 4% of the total volume fraction of carbides and will give a mean inter-carbide spacing of 2.6 to 3.4 microns. In accordance with one embodiment the brittle components may be carbide components in a 50-65 volume percentage. A mean inter-carbide spacing such as this is much smaller that the smallest abrasive wear particles observed in laboratory testing. Therefore, abrasive wear of the ductile area exposed between carbides is significantly eliminated or reduced altogether. One skilled in the art will recognize that in practice the aforementioned carbide sizes are mean carbide sizes. During manufacture, a Gaussian distribution of carbide size is obtained during processing. Therefore, the deviation from this mean should be minimized as much as possible to ensure that the ductile area exposed between carbides is minimized.

Furthermore, based upon experimental testing of downhole tools in a laboratory environment, the wear rate of an abrasive resistant coating is strongly dependent on its surface roughness. Reducing this roughness from a $R_a$ value (mean peak roughness) of 10 microns down to 1 micron can reduce the wear rate by almost a factor of 3. As this surface roughness is often self-perpetuating during wear, i.e., a rough surface will not necessarily smoothen during the abrasion process, it is beneficial to produce an abrasion resistant coating with an initial surface roughness of less than 1 micron $R_a$. By proper selection of primary brittle component size 42 and interstitial brittle component size 44 the initial surface roughness of the abrasion resistant coating can be minimized.

Figure 5A:
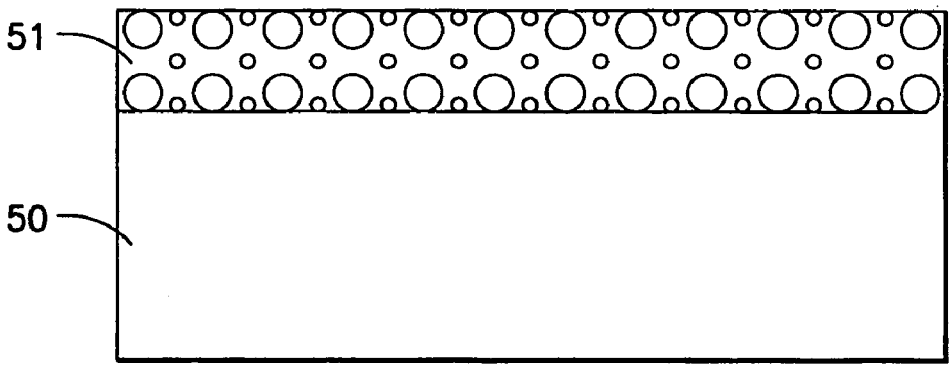
FIG. 5 is an illustrative example of step-wise wear of an abrasive resistant coating applied to a substrate.
Figure 5B:
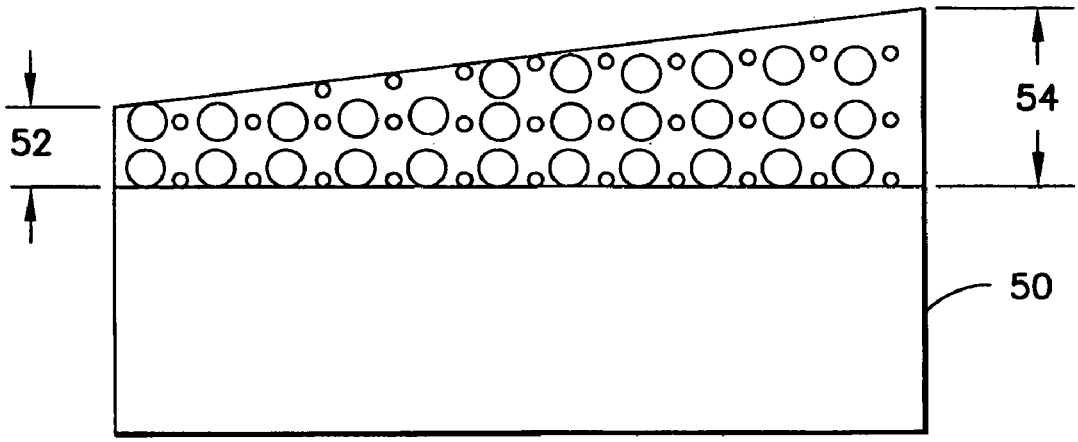
Figure 6:
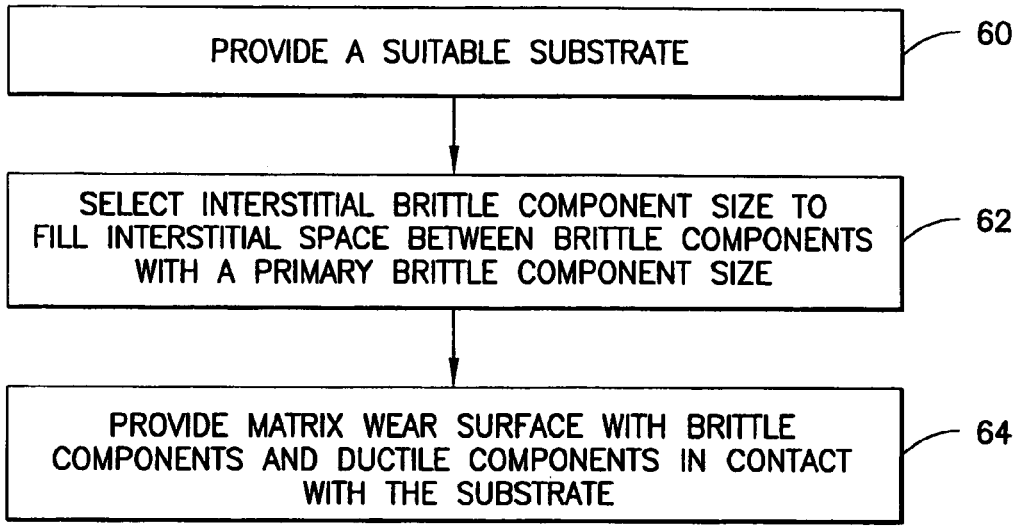
FIG. 6 is a flowchart illustrating the steps necessary in performing an embodiment of the present invention.

Furthermore, in accordance with one embodiment of the present invention the wear surface of the present invention may be applied at either a uniform thickness to a substrate, or in the alternative may be applied at a non-uniform thickness to a substrate. FIG. 5A illustrates the application of a wear surface 51 to a substrate 50 in a uniform thickness. In the alternative, FIG. 5B illustrates the application of a wear surface 55 to a substrate 50 in a non-uniform thickness. As illustrated in FIG. 5B an initial wear surface thickness 52 may be present at one edge of a substrate, while a final wear surface thickness 54 may occur at a second edge of a substrate 50. Such non-uniform applications of a wear-surface are often beneficial in various applicable environments. For example, wear of a wear surface in a downhole environment often initiates at the leading edge of a component. Once the coating is breached in this are, rapid wear can occur in the substrate together with spallation of the coating, leading to stepwise wear as shown in FIG. 6. To provide some degree of protection against this wear mechanism, a relatively thick surface coating may be necessary at the leading edge of the component. One skilled in the art will readily accept that this is only one applicable example of a graded non-uniform application of a wear surface to an appropriate substrate and this example is not intended to be limiting in scope of the present invention. A skilled artisan will realize that numerous alternative environments, substrates and wear surface applications are both possible and in keeping with the present invention.

FIG. 6 is a flowchart illustrating the steps necessary in performing an embodiment of the present invention. In accordance with step 60 of FIG. 6, a substrate is provided. In one embodiment this substrate may be a variety of metallic substances as understood by one skilled in the art. For example, when used in a directional drilling application as illustrated in FIG. 1, the substrate may be metallic in nature. One skilled in the art will readily recognize, however, that the substrate may be manufactured from a variety of materials. The illustration of a metallic tool element in the present invention is therefore not intended to be limiting in scope and is used solely for illustrative purposes. A skilled artisan will note that the substrate may be, but is not limited to, non-metallic elements such as plastics, resins or phenolics, as well as a variety of metallic elements as necessitated by the conditions of the particular application.

In accordance with step 62 of the present embodiment interstitial brittle component size is selected to fill the interstitial spaces between brittle components with a primary brittle component size. Filling of the interstitial vacancies between brittle components with a primary brittle component size results in minimized expose of the ductile matrix material between brittle components. In accordance with one embodiment of the present invention the brittle components and the ductile components exhibit a spherical morphology. The selection of interstitial brittle component size may be governed by a variety of factors. For example, primary brittle component size and interstitial brittle component size selection may be governed by the operating environment of the proposed matrix wear surface. Abrasive material size may first be evaluated to determine the preferred size of the ductile matrix material exposed between brittle components. Upon a determination of the expected. abrasive material size, brittle components (both primary and interstitial) may be select to ensure that the size of the exposed ductile area between brittle components is below the anticipated abrasive size. Selection of brittle component size in accordance with this requirement results in decreased wear in the ductile material between brittle components.

Alternatively, brittle component size may be selected to provide a uniform surface finish at a uniform roughness. Upon proper selection of interstitial brittle component size, and primary brittle component size, the resulting surface roughness of the wear surface may be adequately controlled to result in decreased wear of the wear surface.

In accordance with step 64 of the present invention, a matrix wear surface is provided, wherein this matrix wear surface is in contact with the substrate. Additionally, this matrix wear surface may have both brittle components as well as ductile components. In one embodiment these brittle components may be carbide components. Additionally, the ductile components may be nickel components. Providing of the wear surface in contact with the substrate may occur using a variety of techniques as understood by one skilled in the art. For example, the wear surface in contact with a substrate may be provided using a weld overlay process such as MIG, plasma transfer arc, laser-cladding. Additionally, a thermal spray processes (high velocity oxygen fuel, D-gun, plasma spray, amorphous metal) may be utilized in accordance with the present invention. One skilled in the art will recognize that these are a non-exhaustive list of suitable methods for providing a wear surface in contact with a substrate. This non-exhaustive list, therefore, is not intended to be limiting in scope.

Figure 7:
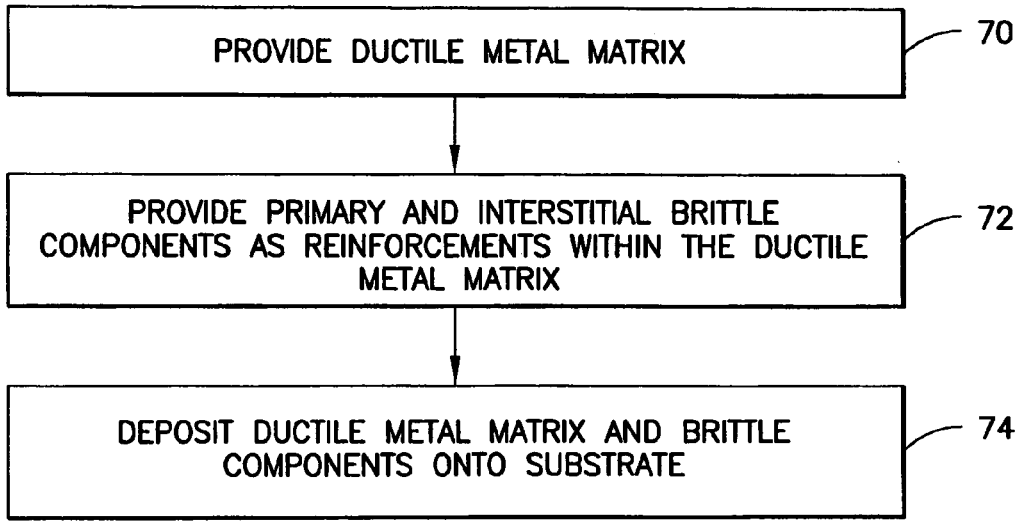
FIG. 7 is a flowchart illustrating the steps necessary in performing an embodiment of the present invention.

FIG. 7 is a flowchart illustrating the steps necessary in performing an embodiment of the present invention. In accordance with step 70 of the present invention a ductile metal matrix is provided. In accordance with one embodiment of the present invention this ductile metal matrix may be a nickel based metal matrix. Primary and interstitial brittle components are then provided as reinforcements within the ductile metal matrix (step 72). These primary and interstitial brittle components are of different sizes. One skilled in the art will recognize that more than 2 differently sized groups of brittle components may be provided. In one embodiment of the present invention these brittle components may be tungsten carbide components. One skilled in the art will readily recognize that numerous alternative brittle components may be utilized in practicing the present invention. The selection of primary and interstitial brittle component size may be based upon numerous factors recited herein, including but not limited to anticipated abrasive size, surface finish requirements, or wear surface requirements. In accordance with one embodiment of the present invention the brittle components have a bimodal size distribution. Utilizing a bimodal size distribution of brittle components allows for the minimization of the ductile metal matrix area. In one embodiment primary brittle component size is about 15-20 microns, while interstitial brittle component size is about 5 to 6.6 microns. Additionally, the separation between the primary brittle components and the interstitial brittle components may be substantially equal. In one embodiment of the present invention the mean interstitial size between primary brittle components and interstitial components is about 2.6 to 3.4 microns.

The ductile metal matrix and brittle components are then deposited onto a substrate in accordance with step 74. The depositing of the ductile metal matrix and brittle components may occur using a variety of techniques, as understood by one skilled in the art. In accordance with one embodiment of the present invention the depositing of the ductile metal matrix and brittle components may occur using a plasma transfer arc (PTA) technique.

The apparatus, systems and methods described above are particularly adapted for oil field and/or drilling applications, e.g., for protection of downhole tools. It will be apparent to one skilled in the art, however, upon reading the description and viewing the accompanying drawings, that various aspects of the inventive apparatus, systems and methods are equally applicable in other applications wherein protection of machine or tool elements is desired. Generally, the invention is applicable in any environment or design in which protection of machine or tool elements subjected to the various wear conditions described above is desired.

The foregoing description is presented for purposes of illustration and description, and is not intended to limit the invention in the form disclosed herein. Consequently, variations and modifications to the inventive abrasive resistant coating systems and methods described commensurate with the above teachings, and the teachings of the relevant art, are deemed within the scope of this invention. These variations will readily suggest themselves to those skilled in the relevant oilfield, machining, and other relevant industrial art, and are encompassed within the spirit of the invention and the scope of the following claims. Moreover, the embodiments described (e.g., tungsten carbide-nickel coatings with a bimodal distribution of brittle components having a spherical morphology) are further intended to explain the best mode for practicing the invention, and to enable others skilled in the art to utilize the invention in such, or other, embodiments, and with various modifications required by the particular applications or uses of the invention. It is intended that the appended claims be construed to include all alternative embodiments to the extent that it is permitted in view of the applicable prior art.

What is claimed is:

1. An abrasion resistant coating for use within an abrasive environment, said abrasive resistant coating comprising:

a substrate;

a wear surface in contact with the substrate and the abrasive environment, said wear surface having ductile components and brittle components;

wherein the interparticle spacing of the brittle components of the wear surface are minimized using a bimodal size distribution for minimizing the exposed area of the ductile components within the wear surface of the abrasion resistant coating; and having a primary brittle component size of about 15-20 microns and a interstitial brittle component size of about 5 to 6.6 microns.

2. The abrasion resistant coating of claim 1, wherein the abrasive resistant coating has 50-65 volume percent tungsten carbide as brittle components within the abrasive resistant coating.

3. The abrasion resistant coating of claim 1, wherein the ductile components are nickel.

4. The abrasion resistant coating of claim 1, wherein the brittle components exhibit a roughly spherical morphology.

5. The abrasion resistant coating of claim 1, wherein the wear surface is applied at a uniform thickness to the substrate.

6. The abrasion resistant coating of claim 1, wherein the wear surface is applied at a non-uniform surface thickness to the substrate.

7. The abrasion resistant coating of claim 5, wherein the substrate is a directional drilling apparatus.

8. The abrasion resistant coating of claim 6, wherein the wear surface is applied at an increased thickness along the leading edge of the directional drilling apparatus in contact with an abrasive environment.

9. The abrasion resistant coating of claim 1, wherein the interparticle spacing of the brittle components is less than 5 microns.

10. The abrasion resistant coating of claim 1, wherein the abrasive environment is a borehole.

11. The abrasion resistant coating of claim 1, wherein the wear surface has an initial surface roughness of less than 1 micron.

12. An abrasion resistant coating for use within an abrasive environment such as in a subterranean environment, the abrasive resistant coating comprising:

a substrate;

a wear surface in contact with the substrate and the abrasive environment, the wear surface having ductile components and brittle components;

wherein the interparticle spacing of the brittle components of the wear surface are minimized using a bimodal size distribution for minimizing the exposed area of the ductile components within the wear surface of the abrasion resistant coating; and a interstitial size between a plurality of primary brittle components and a plurality of interstitial brittle components are approximately 2.6 to 3.4 microns as well as having a primary brittle component size that is approximately equal to or greater than three times of that of a interstitial brittle component size.

13. The method of claim 12, wherein both the brittle components and the ductile components exhibit a spherical morphology.

14. An abrasion resistant coating for use within an abrasive environment such as a downhole environment, the abrasive resistant coating comprising:

a substrate;

a wear surface in contact with the substrate and the abrasive environment, the wear surface having ductile components and brittle components;

wherein the interparticle spacing of the brittle components of the wear surface are minimized using a bimodal size distribution for minimizing the exposed area of the ductile components within the wear surface of the abrasion resistant coating; and wherein a total number of primary brittle components and interstitial brittle components are approximately equal.

15. The method of claim 14, wherein both the brittle components and the ductile components exhibit a spherical morphology.

* * * * *